US010919736B2

(12) United States Patent
Patterson

(10) Patent No.: US 10,919,736 B2
(45) **Date of Patent: *Feb. 16, 2021**

(54) ROD AND CASING HANDLER

(71) Applicant: TEI ROCK DRILLS, INC., Montrose, CO (US)

(72) Inventor: William N. Patterson, Montrose, CO (US)

(73) Assignee: TEI Rock Drills, Inc., Montrose, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/182,002

(22) Filed: Nov. 6, 2018

(65) Prior Publication Data

US 2019/0071288 A1 Mar. 7, 2019

Related U.S. Application Data

(63) Continuation of application No. 15/470,156, filed on Mar. 27, 2017, now Pat. No. 10,150,652.

(51) Int. Cl.
*B66C 1/62* (2006.01)
*E21B 19/14* (2006.01)
(Continued)

(52) U.S. Cl.
CPC ..... *B66C 1/62* (2013.01); *B66C 1/68* (2013.01); *E21B 19/15* (2013.01); *E21B 19/24* (2013.01); *B66F 9/18* (2013.01)

(58) Field of Classification Search
CPC ..... A01G 23/091; B66C 1/427; E21B 19/14; E21B 19/155; E21B 19/20; B26D 3/16; B26D 7/02; Y10T 29/49998
(Continued)

(56) References Cited

U.S. PATENT DOCUMENTS 3,322,456 A 5/1967 Alexandrovich
3,386,295 A 6/1968 Tomlinson
(Continued)

FOREIGN PATENT DOCUMENTS

DE 29 35 944 A1 3/1981
JP 08-296388 A 11/1996
WO WO-2014/199209 A1 12/2014

OTHER PUBLICATIONS

"Hydraulic Casing Handler Attachment" (TEI) May 11, 2016 [online] retrieved from <URL:https://www.youtube.com/watch?v=S1QcypXwbms>.
(Continued)

*Primary Examiner* — Gregory W Adams
(74) *Attorney, Agent, or Firm* — Foley & Lardner LLP

(57) ABSTRACT

A rod and casing handler according to embodiments of the present disclosure includes a boom mount that is configured to be coupled to a boom. A clamp mounting structure is coupled to the boom mount and has a central portion, a first arm, and a second arm, where each arm extends from the central portion. A first clamp is coupled to the first arm and includes a first set of actuatable tongs and a first removable saddle plate. A second clamp is coupled to the second arm, and it includes a second set of actuatable tongs and a second removable saddle plate. The first removable saddle plate has a first arcuate surface sized and shaped to correspond to a cylindrical body having a first diameter, and the second saddle plate has a second arcuate surface sized and shaped to correspond to a cylindrical body having a second diameter, the first and second arcuate surfaces are disposed to hold the first cylindrical body in coaxial alignment with the second cylindrical body.

23 Claims, 5 Drawing Sheets

(51) Int. Cl.

| | |
|---|---|
| ***B66F 9/18*** | (2006.01) |
| ***B66C 1/68*** | (2006.01) |
| ***E21B 19/24*** | (2006.01) |
| ***E21B 19/15*** | (2006.01) |

(58) Field of Classification Search
USPC ..... 166/77.51; 414/22.51–22.59, 414/22.61–22.69, 22.71, 23, 718, 729, 414/739, 740, 745.1, 745.4, 745.5, 745.6, 414/911
See application file for complete search history.

(56) References Cited

U.S. PATENT DOCUMENTS

| | | | | |
|---|---|---|---|---|
| 3,561,811 | A * | 2/1971 | Turner | E21B 19/14 294/90 |
| 3,566,507 | A * | 3/1971 | Jacobsen | B23K 37/0533 29/281.5 |
| 3,922,930 | A | 12/1975 | Fletcher et al. | |
| 3,937,340 | A | 2/1976 | Grove | |
| 3,937,514 | A | 2/1976 | Langowski | |
| 3,991,799 | A | 11/1976 | Albright | |
| 4,175,598 | A | 11/1979 | Stoychoff | |
| 4,280,785 | A | 7/1981 | Albrecht | |
| 4,426,110 | A | 1/1984 | Mitchell et al. | |
| 4,451,194 | A | 5/1984 | Keats et al. | |
| 5,201,501 | A | 4/1993 | Fassler | |
| 5,206,980 | A | 5/1993 | Chapman | |
| 5,219,265 | A | 6/1993 | Recker | |
| 5,609,457 | A | 3/1997 | Burns | |
| 6,382,274 | B1 | 5/2002 | Hicks | |
| 6,408,906 | B1 | 6/2002 | Moon et al. | |
| 6,612,051 | B2 | 9/2003 | Weyer | |
| 7,017,450 | B2 | 3/2006 | Bangert | |
| 7,036,202 | B2 | 5/2006 | Lorenz | |
| 7,607,866 | B2 | 10/2009 | Eddowes et al. | |
| 7,694,583 | B2 | 4/2010 | Liskow et al. | |
| 9,022,442 | B2 | 5/2015 | Rousseau et al. | |
| 9,073,732 | B2 | 7/2015 | Lavalley et al. | |
| 9,085,944 | B2 | 7/2015 | Lavalley et al. | |
| 10,150,652 | B2 * | 12/2018 | Patterson | B66C 1/62 |
| 2009/0057019 | A1 | 3/2009 | Lavalley et al. | |
| 2012/0146353 | A1 | 6/2012 | Lunde | |
| 2014/0042207 | A1 | 2/2014 | Lavalley et al. | |
| 2016/0152456 | A1 | 6/2016 | Magni | |
| 2017/0321501 | A1 | 11/2017 | Comacchio et al. | |

OTHER PUBLICATIONS

Atlas Copco: "Diamec Smart 8: Underground core drill rig for mineral exploration." \cf2\ul www.atlascopco.com <http://www.atlascopco.com>\cf1\ulnone , 5 pages<I>\f1.

Hutte Bohrtechnik GmbH: "Hauptkatalog General Catalogue," \cf2\ul www.casagrandegroup.com <http://www.casagrandegroup.com>\cf1\ulnone , 9 pages.

Hutte Bohrtechnik GmbH: "HDM 89/220 HDM 89/325 Hydraulic manipulator for rods and casings," \cf2\ul www.casagrandegroup.com <http://www.casagrandegroup.com>\cf1\ulnone , 3 pages.

Inside Safety: "Hyperion Cap Lamps, MineARC Systems launches its new range of premium cap lamps in Australia," Jun. 2014, 2 pages.

International Search Report and Written Opinion in corresponding International Patent Application No. PCT/US18/24322, dated Aug. 14, 2018, 13 pages.

Klemm Bohrtechnik GmbH: "Lieferprogramm Product Range," Jan. 2017, 20 pages.

* cited by examiner

ROD AND CASING HANDLER

PRIORITY CLAIM

This application is a continuation of U.S. patent application Ser. No. 15/470,156 entitled "Rod and Casing Handler," filed Mar. 27, 2017, which is incorporated herein by reference for all purposes.

TECHNICAL FIELD

The present disclosure relates to earth boring drilling equipment, and more particularly to a versatile excavator mounted handler for simultaneously handling rods and casings in connection with drilling operations.

BACKGROUND

In earth boring operations, rods and casings are used to create and maintain the bore hole. Rods and casings are each cylindrical bodies that can be made of steel or other relatively sturdy metal material. Rods and casings come in certain lengths, for example 6-10 feet. Lengths of rods and casings can be heavy and may be heavy enough or large enough that more than one individual is required to lift a single length of rod or casing. Lifting rods and casings by hand may be dangerous and inefficient.

Rods and casings are often delivered to a job site on pallets in piles. Equipment that is to handle rods and casings should be able to pick the rods and casings directly from the piles. Finally, there are significant efficiencies that result when rods and casings are handled simultaneously with the rod being positioned inside the casing.

SUMMARY

A rod and casing handler according to embodiments of the present disclosure includes a boom mount that is configured to be coupled to a boom. A clamp mounting structure is coupled to the boom mount and has a central portion, a first arm, and a second arm, where each arm extends from the central portion. A first clamp is coupled to the first arm and includes a first set of actuatable tongs and a first removable saddle plate. A second clamp is coupled to the second arm, and it includes a second set of actuatable tongs and a second removable saddle plate. The first removable saddle plate has a first arcuate surface sized and shaped to correspond to a cylindrical body having a first diameter, and the second saddle plate has a second arcuate surface sized and shaped to correspond to a cylindrical body having a second diameter.

Technical advantages of a rod and casing handler according to the teachings of the present disclosure include easily removable and replaceable saddle plates and tongs, where saddle plates and tongs can be installed to correspond a particular diameter cylindrical body. In addition, one of the two clamps may have saddle plates corresponding to smaller diameter cylindrical bodies and the other of the two clamps may have saddle plates corresponding to cylindrical bodies with a larger diameter. The rod and casing clamp according to this configuration can be used to grip and manipulate simultaneously the two cylindrical bodies with the different diameters.

Other technical advantages will be readily apparent to one of ordinary skill in the art from the following figures, descriptions, and claims. Moreover, while specific advantages have been described above, various embodiments may include all, some, or none of the enumerated advantages.

BRIEF DESCRIPTION OF THE DRAWINGS

A more complete understanding of the present invention may be acquired by reference to the following Detailed Description when taken in conjunction with the accompanying Drawings wherein.

DETAILED DESCRIPTION OF THE DRAWINGS

Figure 1A:
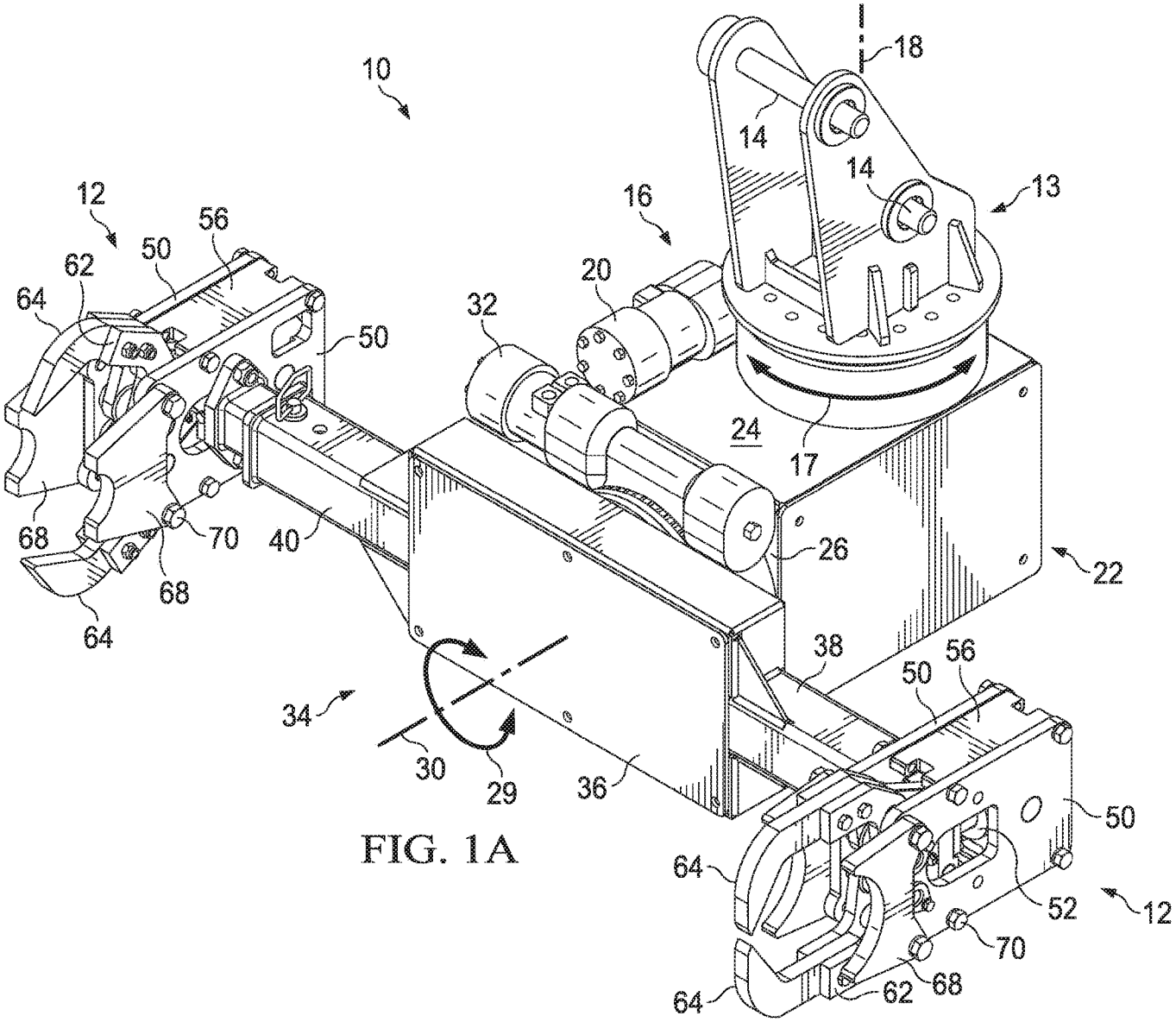
FIGS. 1A and 1B are assembled and exploded perspective views of a rod and casing handler according to the teachings of the present disclosure.
Figure 1B:
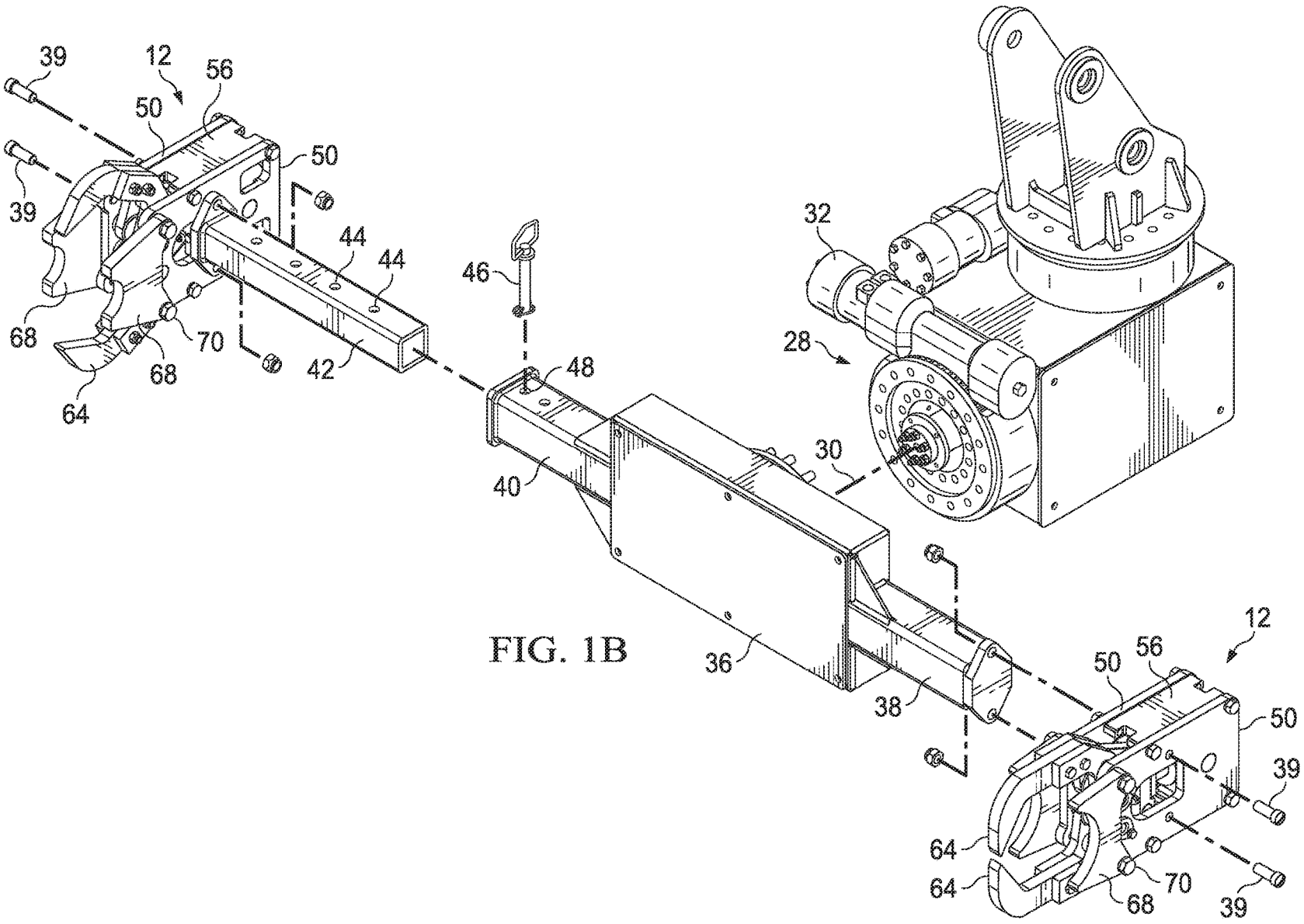

Reference is made to FIGS. 1A and 1B, which are assembled and exploded views respectively of a casing and rod handler 10, which may also be referred to as a casing and rod manipulator, according to the teachings of the present disclosure. The casing and rod handler 10 attaches to an excavator and uses the hydraulic system of the excavator to actuate tongs associated with a pair of hydraulic clamps 12 disposed at distal ends of the arm. The clamps 12 grab heavy cylindrical bodies such as rods, pipes, casings, and the like, which are commonly used in earth drilling operations. The casing and rod handler 10 can actuate to clamp and handle or manipulate a large diameter casing and a smaller diameter rod simultaneously and concentrically. Typically, the rod is inserted within the casing such that a portion of the rod extends from the casing. A first clamp grasps the casing and the second clamp, which is independently actuated from the first clamp, grasps the portion of the smaller diameter rod outside of the casing (see FIG. 4). In this manner, rods and casing may be simultaneously handled, which simplifies inserting rods and casings and other cylindrical bodies into a drilled hole or removing rods and casings and other cylindrical bodies from a drilled hole.

The rod and casing handler 10 includes an excavator mount 13 that is configured to be grasped and secured to an excavator or other types of construction equipment with a hydraulic system and a boom. An operator in a cabin of the excavator or other construction equipment controls movement of the excavator's tracked or wheeled propulsion system and also controls the boom of the excavator. Oftentimes, the excavator is equipped with a hydraulic system, that when connected to a separate hydraulically actuated device or tool allows the operator to actuate the hydraulics to control the separate tool. For example, hydraulic systems of an excavator are used for clamping, drilling, pumping, digging/excavating, and the like. In the illustrated embodiment, the excavator mount 13 includes multiple bars 14 that can be grasped and held by a clamp disposed at the end of the boom of the excavator. Alternatively, the bars 14 may be received through corresponding holes in the excavator mount 13 and the boom of the excavator and secured in position with one or more hitch pins. The bucket of the excavator is removed and replaced by the excavator mount 13, which allows the casing and rod handler 10 to be moved and positioned by the boom of the excavator.

The excavator mount 13 is secured to a handler positioner 16 that facilitates rotation with respect to the excavator mount 13. According to one embodiment, the handler positioner 16 includes one or more gears and bearing surfaces that allow for rotation in a direction indicated by arrow 17 about an axis 18. The axis 18 may be associated with a center of one or more circular gears. A motor 20 drives the gears. In one embodiment, the shaft driven by the motor 20 is an elongated threaded shaft where the threads engage with a circular gear. This is referred to as a worm drive gear arrangement, and the elongated threaded shaft is referred to as a worm or worm screw and the circular gear, which is similar to a spur gear, is referred to as a worm gear or worm wheel. Electric current supplied to the motor rotates the worm screw, which rotates the worm gear and thereby rotates the rod and casing handler 10 with respect to the axis 18 and with respect to the excavator mount 13.

A control box 22 is secured to the handler positioner 16. The control box 22 houses the hydraulic and electrical components that allow the rod and casing handler 10 to be positioned and allow the clamps 12 to be actuated. According to one embodiment, the components housed in the control box 22 communicate by wired or wireless communications with a joystick control in the cab of an excavator. Manipulation of the joystick control allows the operator to move the rod and casing handler 10 and actuates its clamps 12 to handle and manipulate cylindrical bodies, such as heavy rods, pipes, and casings. The control box 22 is generally box-shaped, and one face 24 of the control box 22 is connected to the handler positioner 16. A second face 26 of the control box 22 that is orthogonal to the first face 24 is connected to an arm positioner 28. The arm positioner 28 rotates or rolls the arm to which the clamps 12 are attached. The arm and clamps 12 roll in a direction indicated by arrow 29 about a second axis 30. The arrangement allows rotational motion of the clamps about two axes of rotation, which are orthogonal to each other.

According to one embodiment, the arm positioner 28 includes a motor 32. The arm positioner 28 includes the same worm drive gear arrangement as described above with respect to the handler positioner 16. Similarly, to the handler positioner 16, the arm positioner may be controlled by wired or wireless communication with a joystick in the cab of the excavator. As described in more detail below, a hydraulic swivel may facilitate positioning of electric wires within a swivel component that allows the electric wire to extend through a junction of rotating components without the wire becoming twisted or tangled.

A clamp mount assembly 34 is coupled to the arm positioner 28 opposite the control box 22. The clamp mount assembly 34 includes a box-shaped central portion 36, a first arm 38 extending in a first direction from the central portion 36 and a second arm 40 extending in an opposite direction from the central portion 36. The central portion 36 houses hydraulic hoses and valves and the like that are components of the hydraulic system that actuates the clamps 12.

According to one embodiment, a hydraulic swivel fluidly couples hydraulic fluid conduits exiting the control box 22 and entering the central portion 36 of the clamp mount assembly 34. The hydraulic swivel is disposed along the axis 30 and allows the clamp mount assembly 34 to rotate over 360 degrees with respect to the control box 22 without twisting the hydraulic lines. The hydraulic lines (not shown) may run external to the clamp mount assembly 34, or they may run internal to the structure of the clamp mount assembly 34.

In addition, the hydraulic swivel can also be fitted with an electrical section that allows electrical wires to pass through the junction of the control box 22 and the clamp mount assembly 34, which rotates with respect to the control box 22. The electrical wires run through the rotating connection, such that the clamp mount assembly 34 is free to rotate or roll over 360 degrees without twisting or tangling the electric wires.

Electrical communication is made with position sensors, other sensors, and other electromechanical devices disposed on the clamp mount assembly 34. This electrical communication allows the sensors to communicate with equipment and the operator in the cabin of the excavator and allows the operator to electrically communicate with the clamp mount assembly 34 and the clamps 12.

The ability to rotate beyond 360 degrees and maintain electrical and hydraulic connections allows the operator to efficiently rotate or roll the clamp mount assembly 34 and the clamps 12 to any desired position from any starting position and to use the most direct rotational motion to arrive at the desired position.

The first arm 38 is an elongated member connected on one end to the central portion 36 and connected at an opposite end to a clamp 12 by one or more bolts 39. According to one embodiment, the second arm 40 may be generally hollow and configured to receive an adjustable clamp mounting member or arm 42. The adjustable clamp mounting arm 42 includes a plurality of holes 44 configured to receive a pin 46 that extends through a corresponding hole 48 in the second arm 40. The holes 44 allow the adjustable clamp mounting arm 42 to be extended a greater distance from the central portion 36, and thus the length of the cylindrical bodies that can be handled by the rod and casing handler 10 can likewise be increased. The distance between the first and second clamps is increased, which allows longer cylindrical bodies to be handled, or allows for separate cylindrical bodies to be handled by separate clamps 12 without the cylindrical bodies interfering with each other. For example, one of the clamps 12 may be telescoped from a minimum distance between clamps 12 of approximately 57 inches to a maximum distance between clamps 12 of 66 inches. This allows handling of casings from 57 inches to 120 inches in length.

Figure 2:
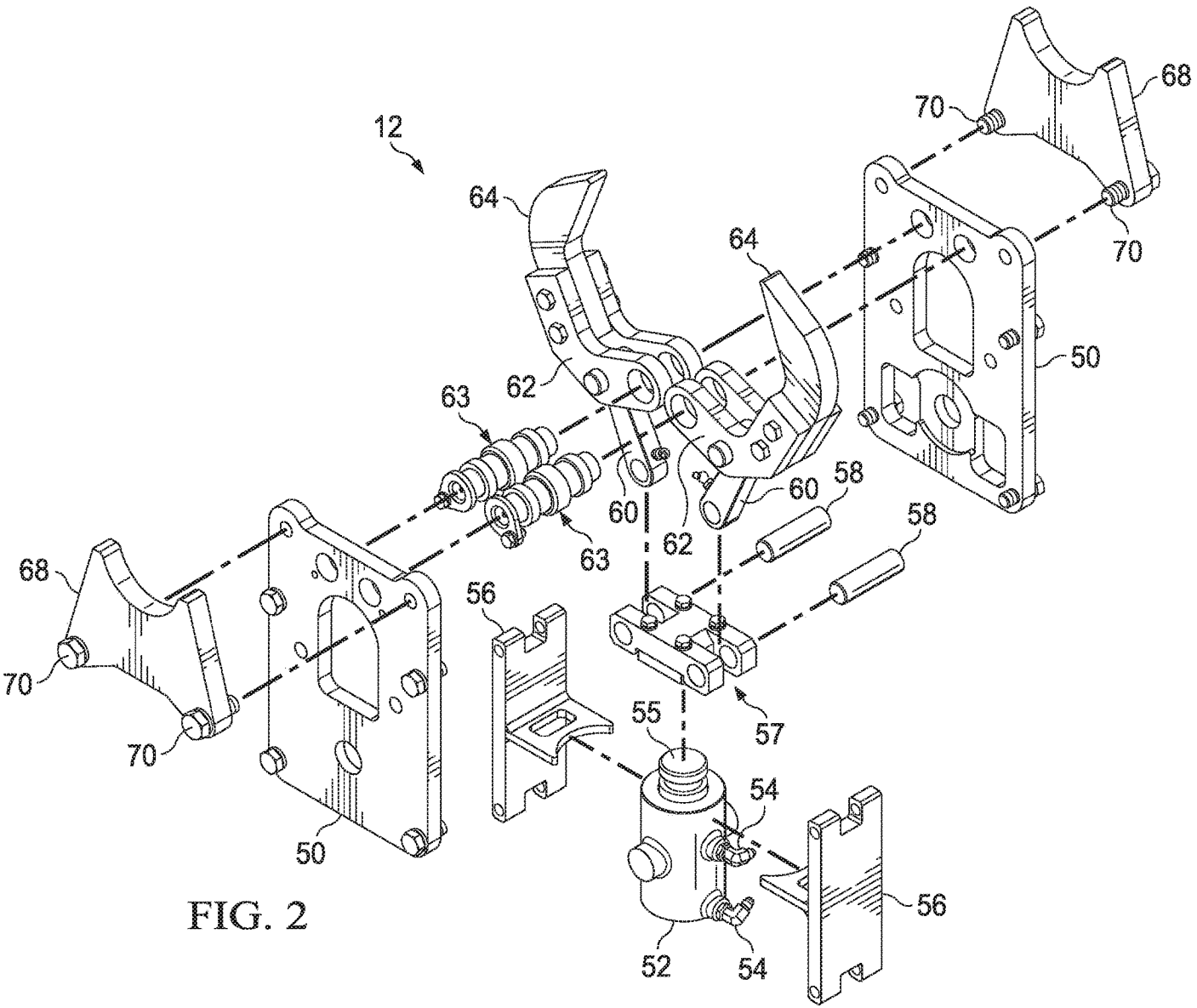
FIG. 2 is an exploded perspective view of a hydraulic clamp of the rod and casing handler of FIGS. 1A and 1B.

Each of the first and second clamps 12 may be generally the same, with the exception that the tongs and saddle plates are selectable to be different sizes, as described below. FIG. 2 is an exploded view of one of the clamps 12, according to embodiments of the present disclosure. A mounting plate 50 is disposed on either side of a hydraulic cylinder 52. The hydraulic cylinder 52 includes fittings 54 that allow hydraulic fluid to flow and displace a movable piston 55 in the hydraulic cylinder 52. A pair of side support brackets 56 surrounds the hydraulic cylinder 52. The hydraulic cylinder 52 is connected by one or more pins 58 to a pair of linkage bars 60. The pins are connected to the displaceable piston 55 by a pin connecting member 57.

A first linkage bar 60 is connected to a first actuatable arm 62, which is connected to a first tong 64. A second linkage bar 60 is connected to a second actuatable arm 62, which is connected to a second tong 64. The connection of the linkage bar 60 to the actuatable arm 62 is offset from a pivot point of the arm 62 to create a torque such that the actuatable arm 62 is rotatable or pivotable about the pivot point. Rotation of each of the actuatable arms 62 about the pivot point is enabled by a bearing assembly 63. Hydraulic actuation and displacement of the piston 55 within the hydraulic cylinder 52 acts on the linkage bars 60, which in turn pivots the actuatable arms 62 to open and close the tongs 64. Each tong 64 is identical and includes a distal portion that is configured to be positioned around a cylindrical body. The tongs 64 do not require excessive gripping force because their function is to hold the cylindrical object against the saddle plates 68. According to one embodiment, a maximum gripping or clamping force of the tongs 64 supplied by the hydraulic cylinder 52 is approximately 8000 pounds-force.

According to one embodiment, a pair of saddle plates 68 is disposed outside the mounting plates 50. A pair of bolts 70 or similar fasteners secures the saddle plate 68 to the mounting plate 50. This configuration allows the saddle plates 68 to be easily accessible, which facilitates removal and replacement of the saddle plates 68. The mounting plates include appropriate through holes and recesses to allow clearance for the hydraulic cylinder 52 and access to the hydraulic fittings 54 without removing the mounting plates 50.

Figure 3A:
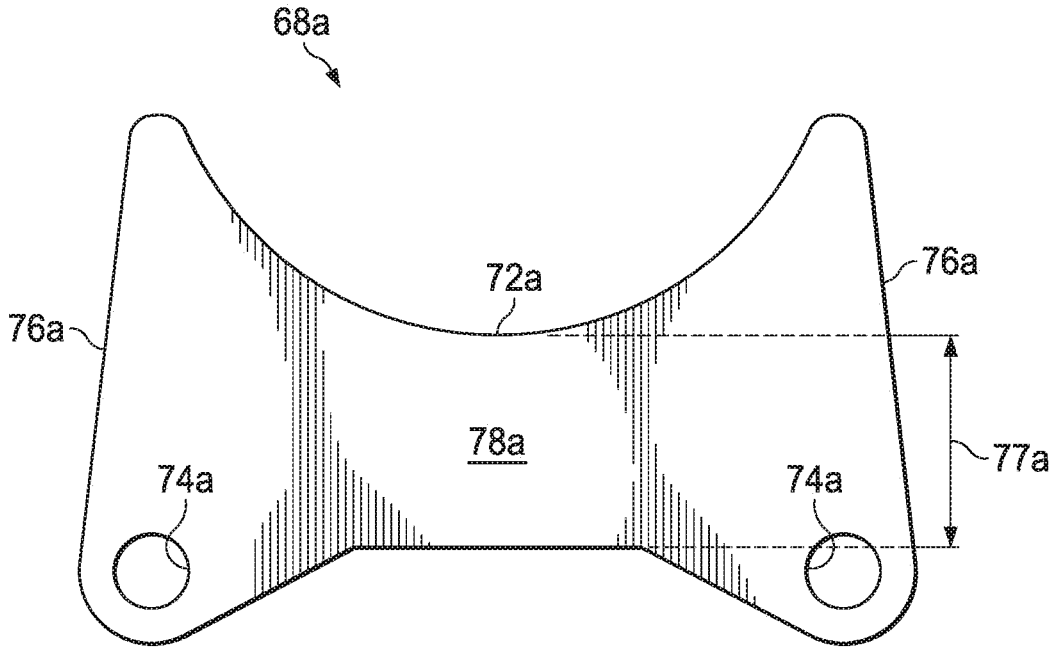
FIGS. 3A and 3B are side elevation view of a saddle plate of the rod and casing handler of FIGS. 1A and 1B.
Figure 3B:
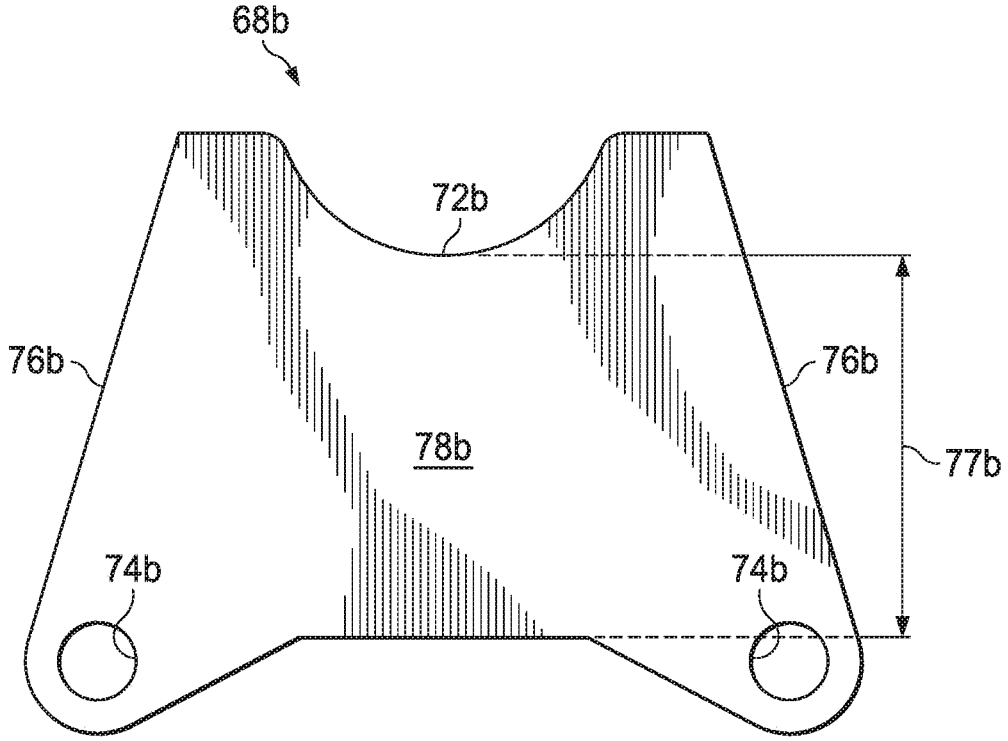

Reference is made to FIGS. 3A-3B, which are side elevation views of saddle plates 68*a* and 68*b*. Each saddle plate 68*a* and 68*b* has a front face 78*a*, 78*b*, and an opposite rear face. Each saddle plate 68*a*, 68*b* includes a pair of through holes 74*a*, 74*b* through which the bolt 70 or other fastener is received to secure the saddle plate 68*a*, 68*b* to a mounting plate 50. The through holes 74*a* are spaced apart from each other the same distance as the through holes 74*b* are spaced apart from each other. This allows the saddle plate 68*a* to be interchangeable with the saddle plate 68*b*.

Each saddle plate 68*a*, 68*b* includes an arcuate surface 72*a*, 72*b*. The arcuate surface 72*a* is sized and shaped to correspond to a range of diameters of cylindrical bodies. For example, the arcuate surface 72*a* of the saddle plate 68*a* shown in FIG. 3A, is sized to correspond to cylindrical object with a diameter of approximately 10.625 inches, for example a segment of a casing. For smaller diameter cylindrical bodies, such as a rod or pipe, the arcuate surface 72*b* of the saddle plate 68*b* shown in FIG. 3B is used because it is sized and shaped to correspond to cylindrical bodies with a smaller diameter, for example, rods and pipes handled by the saddle plate 68*b* may have an outer diameter of approximately 3.5 inches. A side surface 76*b* of the saddle plate 68*b* may be slanted at a greater angle than the slant angle of the side surfaces 76*a* of the saddle plate 68*a*. This allows the arcuate surface 72*b* to accommodate a smaller diameter, while maintaining the spacing of the through holes for common mounting to the plate 50.

A distance 77*a* between a line extending through the center of through holes 74*a* and the arcuate surface 72*a* for the larger diameter saddle plate 68*a* is less than a corresponding distance 77*b* of the smaller diameter saddle plate 68*b*. This difference in distance accommodates the different sized diameter pipes and casings and ensures that a pipe is maintained in coaxial alignment in a casing when the casing is gripped by one clamp 12 and the pipe is gripped by the other clamp 12 at the opposite end of the clamp mount assembly 34. This coaxial and concentric arrangement of two cylindrical bodies with different diameters allows drill pipe and casings to be efficiently added or removed at a drill site.

The tongs 64 used with the saddle plate 68*a* are larger than the tongs 64 used with the saddle plate 68*b*. According to certain embodiments, one size tongs may be used with multiple different sized saddle plates. For example, an appropriately sized pair of tongs 64 is used with saddle plates sized and shaped to correspond to cylindrical bodies, such as pipes, that have an outer diameter in a range of 3.5 inches to 6 inches. The rod and casing handler 10 and the various sized and shaped saddle plates and correspondingly sized tongs are configured to handle small diameter threaded rods, larger diameter pipes of 3.5 inches up to casings with an outer diameter of approximately 10.625 inches.

Figure 4:
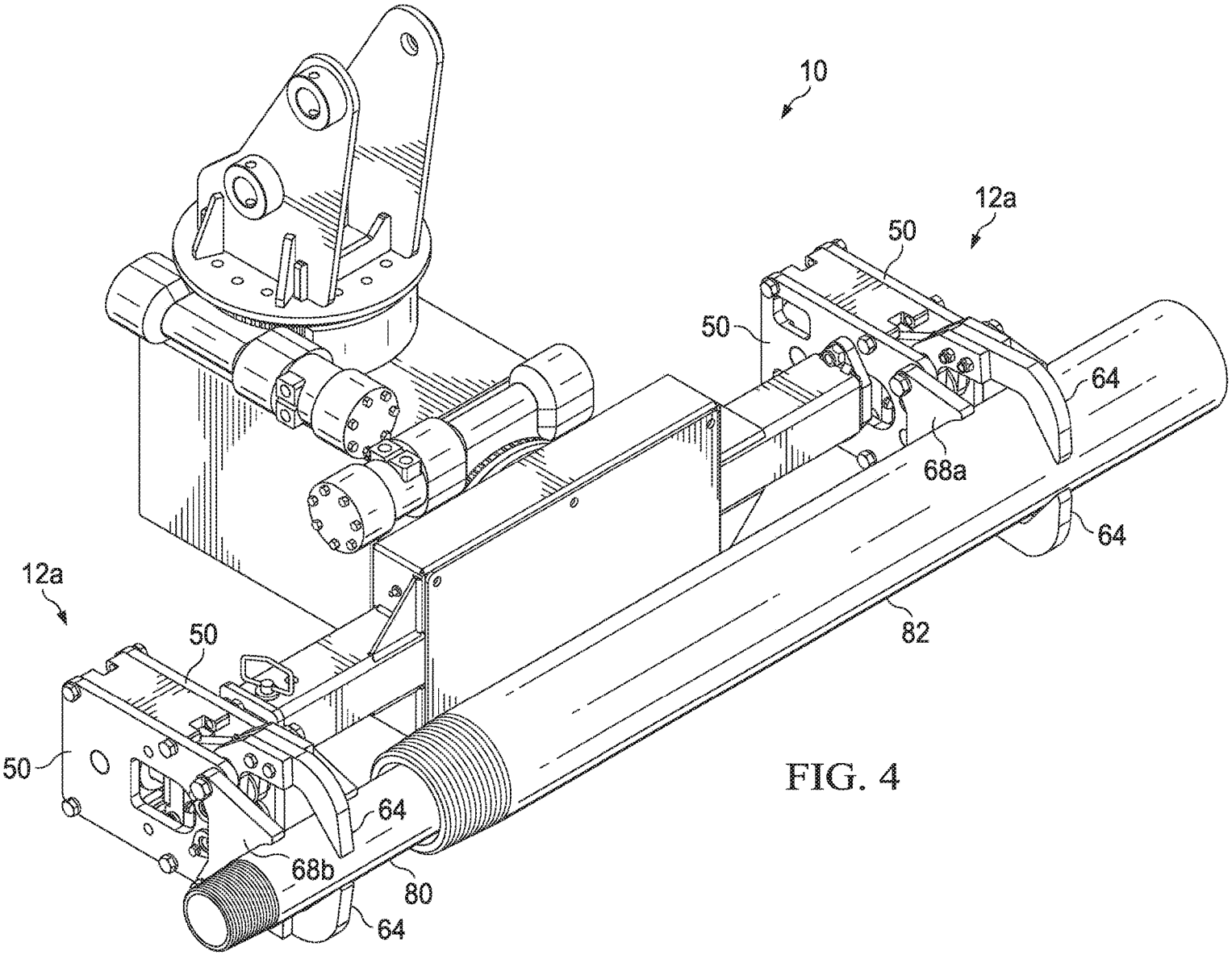
FIG. 4 is a perspective view of the rod and casing handler of FIGS. 1A and 1B simultaneously gripping a rod in one hydraulic claim and a casing in the other hydraulic clamp.

Reference is made to FIG. 4, which is a perspective view of a rod and casing handler 10 simultaneously handling a pair of cylindrical bodies, for example a rod 80 and a casing 82. A single rod and casing handler 10 may be used in one instance to handle and grip cylindrical bodies of one size, and the same rod and casing handler 10 may be used to handle cylindrical bodies of a different size, either sequentially or simultaneously.

As shown in FIG. 4, the saddle plates 68*a* of FIG. 3A may be secured to the clamp 12*a* so that casings with a relatively larger diameter can be handled by the clamp 12*a*, and the saddle plates 68*b* that are sized and shaped to correspond to a smaller diameter cylindrical object such as a pipe or rod is handled by the clamp 12*b* simultaneously with the casing handling of the clamp 12*a*. According to one embodiment, one clamp, or example one or more mounting plates 50 of the clamp 12*b* can be colored differently, for example yellow, to allow the operator to easily distinguish the smaller diameter saddle plates from the larger diameter saddle plates from his position in the cabin of the excavator.

A pallet of casings also may be handled by the rod and casing handler 10 with a larger size arcuate surface of the saddle plates, for example the saddle plates 68*a* shown in FIG. 3A. The saddle plates 68*a* may be removed and replaced with the saddle plates 68*b*, and a pallet of pipes having a smaller diameter than the casings can be handled by the same rod and casing handler 10. Removal and replacement of the saddle plates may be accomplished by removing the bolts 70 that secure the saddle plate 68 to a mounting plate 50.

According to some embodiments, the tongs 64 are removable and replaceable similar to the saddle plates to facilitate handling of differently sized cylindrical bodies. For example, longer tongs may be attached when saddle plates that are sized and shaped to handle larger diameter cylindrical bodies are attached. A supplier may offer a set of saddle plates 68 and tongs 64 that are sized to handle cylindrical bodies with a particular diameter range.

In operation, the tongs 64 on the clamp 12*a* may be opened such that the clamp 12*a* may be lowered onto a pipe, rod, or casing. The arcuate surface 72*a* of the saddle plates 68*a* engage the outer surface of the pipe, rod or casing. The tongs 64 are closed by the operator and they grasp the side of the pipe opposite the side of the pipe in contact with the arcuate surfaces 72*a*. With the tongs 64 closed around the pipe, the casing and rod handler 10 may be lifted away from the pile of pipe. A single clamp 12*a* can grasp a single pipe.

According to an alternate use of the casing and rod handler 10, a smaller diameter pipe may be grasped by the clamp 12*b* as described above, and then the smaller diameter pipe may be inserted into a larger diameter pipe. The clamp 12*a* then closes around the lager diameter pipe with the larger diameter pipe seated on the larger radius arcuate surface. In this manner, two pieces of pipe are handled by the same rod and casing handler 10 simultaneously.

As described above with respect to FIGS. 3A and 3B, the rod/pipe 80 inserted in the casing 82 are held in concentric and coaxial alignment with each other. In addition, the tongs 64 hold the rod 80 and the casing 82 securely against the respective saddle plates 68*b*, 68*a*. The contact between the saddle plate and a substantial portion of a diameter of the outer cylindrical surface holds the cylindrical bodies such that they do not rotate when engaged by the tongs 64. This may be a considerable improvement over scissor type clamps that permit certain rods and casings to rotate, even when gripped by the scissor clamp.

Although preferred embodiments of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A handler, comprising:

a boom mount configured to be coupled to a boom;

a clamp mounting structure coupled to the boom mount and having a central portion and a first arm and a second arm, each arm extending from the central portion;

a first clamp coupled to the first arm and comprising a first set of actuatable tongs and a first saddle plate having a first arcuate surface, the first arcuate surface having a first radius corresponding to a first cylindrical body having a first diameter; and a second clamp coupled to the second arm and comprising a second set of actuatable tongs and a second saddle plate having a second arcuate surface, the second arcuate surface having a second radius corresponding to a second cylindrical body having a second diameter, wherein the first diameter is greater than the second diameter and the first arcuate surface and the second arcuate surface are disposed to hold the first cylindrical body in coaxial alignment with the second cylindrical body.

2. The handler of claim 1 wherein the clamp mounting structure has a first axis of rotation with respect to the boom mount and a second axis of rotation with respect to the boom mount.

3. The handler of claim 2 wherein the first axis of rotation is orthogonal to the second axis of rotation.

4. The handler of claim 2 wherein the clamp mounting structure is rotatable at least 360 degrees with respect to the first axis of rotation and rotatable at least 360 degrees with respect to the second axis of rotation.

5. The handler of claim 1 wherein the boom is part of an excavator and hydraulic fluid to actuate the first and second set of actuatable tongs is supplied by a hydraulic system of the excavator.

6. The handler of claim 1 wherein the clamp mounting structure is rotatable about a first axis of rotation with respect to the boom mount and is rotatable about a second axis of rotation with respect to the boom mount, and further comprising a first motor operable to rotate the clamp mounting structure with respect to the first axis of rotation and a second motor operable to rotate the clamp mounting structure with respect to the second axis of rotation.

7. The handler of claim 6 wherein rotation of the clamp mounting structure about the first and second axes of rotation is facilitated by worm drive gear arrangements.

8. The handler of claim 1 wherein the first saddle plate comprises a pair of first removable saddle plates and the second saddle plate comprises a pair of second removable saddle plates.

9. The handler of claim 8 wherein the first set of actuatable tongs is disposed between the pair of first removable saddle plates and the second set of actuatable tongs is disposed between the pair of second removable saddle plates.

10. The handler of claim 1 wherein the first set of actuatable tongs is operable to actuate independently of the second set of actuatable tongs.

11. The handler of claim 1 wherein the first arm includes a telescoping member configured to adjust a distance between the first clamp and the second clamp.

12. The handler of claim 1 wherein the first arcuate surface is disposed with respect to the second arcuate surface such that seating the first cylindrical body in the first arcuate surface and seating the second cylindrical body in the second arcuate surface disposes the first cylindrical body coaxially aligned with the second cylindrical body.

13. The handler of claim 1 wherein the first arcuate surface is disposed with respect to the second arcuate surface such that when the first arcuate surface is in full contact with the first cylindrical body and the second arcuate surface is in full contact with the second cylindrical body, the first cylindrical body will be coaxially aligned with the second cylindrical body.

14. A handler, comprising:

an excavator mount configured to be coupled to a boom of an excavator;

a clamp support structure coupled to the excavator mount and having a central portion and a first arm and a second arm each arm extending from the central portion;

a first clamp coupled to the first arm comprising a first set of hydraulically actuated tongs and a pair of first saddle plates, and the first saddle plates each having a first arcuate surface, each of the first arcuate surfaces having a first radius corresponding to a first cylindrical body having a first diameter;

a second clamp coupled to the second arm comprising a second set of hydraulically actuated tongs and a pair of second saddle plates, and the second saddle plates each having a second arcuate surface, each of the second arcuate surfaces having a second radius corresponding to a second cylindrical body having a second diameter, wherein the first diameter is greater than the second diameter; and wherein the first clamp is operable to grip the first diameter cylindrical body and the second clamp is operable to grip the second diameter cylindrical body simultaneously with the first clamp gripping the first diameter cylindrical body and with the first and second diameter cylindrical bodies being coaxially aligned.

15. The handler of claim 14 wherein the excavator supplies hydraulic fluid to actuate the first and second set of hydraulically actuated tongs.

16. The handler of claim 14 wherein the first set of hydraulically actuated tongs is disposed between the pair of first saddle plates and the second set of hydraulically actuated tongs is disposed between the pair of second saddle plates.

17. The handler of claim 14 wherein the clamp support structure is rotatable at least 360 degrees about a first axis of rotation with respect to the excavator mount and is rotatable at least 360 degrees about a second axis of rotation with respect to the excavator mount, the second axis of rotation being orthogonal to the first axis of rotation, and further comprising a first motor operable to rotate the clamp support structure with respect to the first axis of rotation and a second motor operable to rotate the clamp support structure with respect to the second axis of rotation.

18. The handler of claim 14 wherein the first arm includes a telescoping member configured to adjust a distance between the first clamp and the second clamp.

19. The handler of claim 14 wherein the first diameter is greater than the second diameter and wherein the first arcuate surface is disposed with respect to the second arcuate surface such that when the first arcuate surface is in full contact with the first diameter cylindrical body and the second arcuate surface is in full contact with the second diameter cylindrical body, the first diameter cylindrical body will be coaxially aligned with the second diameter cylindrical body.

20. The handler of claim 14 wherein the pair of first saddle plates and the pair of second saddle plates are removable.

21. A handler, comprising:

an excavator mount configured to be coupled to a boom of an excavator; a clamp support structure coupled to the excavator mount and having a central portion and a first arm and a second arm each arm extending from the central portion;

a first clamp coupled to the first arm comprising a first set of hydraulically actuated tongs disposed between a pair of first saddle plates, and the first saddle plates each having a first arcuate surface, each of the first arcuate surfaces having a first radius corresponding to a first cylindrical body having a first diameter;

a second clamp coupled to the second arm comprising a second set of hydraulically actuated tongs disposed between a pair of second saddle plates, and the second saddle plates each having a second arcuate surface, each of the second arcuate surfaces having a second radius corresponding to a second cylindrical body having a second diameter, wherein the first diameter is greater than the second diameter;

a first motor operable to rotate the clamp support structure about a first axis of rotation with respect to the excavator mount; and a second motor operable to rotate the clamp support structure with respect to a second axis of rotation with respect to the excavator mount, the second axis of rotation being orthogonal to the first axis of rotation;

wherein the first arcuate surface is disposed with respect to the second arcuate surface such that when the first arcuate surface is in full contact with the first cylindrical body and the second arcuate surface is in full contact with the second cylindrical body, the first cylindrical body will be coaxially aligned with the second cylindrical body.

22. The handler of claim 21 wherein rotation of the clamp support structure about the first and second axes of rotation is facilitated by worm drive gear arrangements.

23. The handler of claim 21 wherein the pair of first saddle plates and the pair of second saddle plates are removable.

* * * * *